United States Patent [19]

Brady

[11] Patent Number: 4,872,229

[45] Date of Patent: Oct. 10, 1989

[54] WATERPROOF INFLATABLE MASSAGE AIR MATTRESS

[76] Inventor: Antonio Brady, 2401 Beta St., San Diego, Calif. 92112

[21] Appl. No.: 177,314

[22] Filed: Apr. 4, 1988

Related U.S. Application Data

[63] Continuation-in-part of Ser. No. 38,997, Feb. 13, 1987, which is a continuation-in-part of Ser. No. 887,533, Jul. 21, 1986, abandoned, which is a continuation-in-part of Ser. No. 887,730, Jul. 21, 1986, abandoned, which is a continuation-in-part of Ser. No. 788,825, Oct. 18, 1985, abandoned.

[51] Int. Cl.[4] ..... A47C 27/10; A61G 7/04

[52] U.S. Cl. ..... 5/455; 5/449; 128/33

[58] Field of Search ..... 5/455, 449, 450, 441, 5/448, 462; 128/33; 297/DIG. 3

[56] References Cited

U.S. PATENT DOCUMENTS

| | | | |
|---|---|---|---|
| 3,601,121 | 8/1971 | Roberts | 5/436 |
| 3,981,032 | 9/1976 | Brooks | 128/33 |
| 4,099,773 | 7/1978 | Chang | 128/33 |

FOREIGN PATENT DOCUMENTS

| | | | |
|---|---|---|---|
| 1161834 | 9/1958 | France | 5/455 |

OTHER PUBLICATIONS

"Bath Massage Pillow" TM a trade brochure by Glendale Associates-1101 Cobb Parkway, S.E. Marietta, Ga. 30062 ©1986.

*Primary Examiner*—Alexander Grosz

*Attorney, Agent, or Firm*—Charles C. Logan, II

[57] ABSTRACT

A waterproof inflatable massage air mattress having an inflatable head cushion portion that is spaced a predetermined distance from its inflatable body cushion portion. In the space therebetween is formed a vibrator cushion portion. The vibrator cushion portion has a chamber closed at its rear end and its front end is opened and closed by a water impermeable linear seal. A vibrator assembly is removably received within the chamber and it is formed from a tubular foam core within which is positioned a vibrator unit. The vibrator unit has a vibrator motor and batteries that are electrically connected together and also connected to a button switch that is mounted in the rear end wall of the tubular foam core. A primary flap and a secondary flap provide protective cover for the water impermeable linear seal.

6 Claims, 1 Drawing Sheet

WATERPROOF INFLATABLE MASSAGE AIR MATTRESS

BACKGROUND OF THE INVENTION

This application is a continuation-in-part of an application filed on 2/13/87, having Ser. No. 038,997, which was a continuation-in-part of an application filed on 7/21/86, having Ser. No. 887,533, now abandoned which was a continuation-in-part of an application filed on 7/21/86, having Ser. No. 887,730 now abandoned, which was a continuation-in-part of an application filed on 10/18/85, having Ser. No. 06/788,824 now abandoned.

The invention is also the subject of the following Disclosure Statements with the following filing dates: 150,194, 5/12/86; 151,298, 6/2/86; 153,423, 7/21/86; 153,606, 7/22/86; 153,954, 7/28/86; 154,254, 8/5/86; 154,438, 8/11/86; 155,697, 9/8/86; 158,457, 11/3/86.

The invention relates to an air mattress and more specifically to one that is made of waterproof material and which also includes a vibrator assembly for massaging the neck area of a person laying thereon.

In the past inflatable air mattresses have existed that have been used in swimming pools and in lakes. These generally have had a body cushion portion and a head cushion portion. None of them have been provided with any structure for providing a relaxing massage to the neck area of the person laying on the air mattress.

It is an object of the invention to provide a novel waterproof inflatable massage air mattress having a vibrator assembly removably received within a chamber located at a position approximately adjacent where a persons neck would be located while laying on the air mattress.

It is also an object of the invention to provide a novel waterproof inflatable massage air mattress that is economical to manufacture and market.

It is another object of the invention to provide a novel waterproof inflatable massage air mattress that has a unique vibrator assembly chamber having a water impermeable linear seal structure formed at its open end.

It is an additional object of the invention to provide a novel waterproof inflatable massage air mattress that can have its vibrator unit actuated by merely pressing against the rear external wall of the vibrator cushion portion.

SUMMARY OF THE INVENTION

Applicant's invention relates to a waterproof inflatable massage air mattress that can be used in swimming pools, lakes or other swimming areas. The air mattress has the conventional longitudinally elongated inflatable body cushion portion that extends for the majority of the length of the air mattress and it has a transversely extending inflatable head cushion portion adjacent the front end of the air mattress. Intermediate the body cushion portion and the head cushion portion is the vibrator cushion portion.

The vibrator cushion portion has a vibrator assembly chamber that is closed at its rear end and it has a water impermeable zipper or linear seal structure at its front end. The linear seal structure could be the same as a fastener structure such as the one sold under the trade mark of ziplock. A plurality of flaps are so arranged to overlap the linear seal structure to provide a protective structure therefore.

The vibrator assembly is formed of a tubular foam core having closed front and rear end walls at its respective ends. A vibrator unit is positioned within the tubular foam core and it has a plurality of batteries that are electrically connected to a vibrator motor and these are also electrically connected to a button switch that is mounted in the rear wall of the tubular foam core. The vibrator assembly is inserted into the vibrator assembly chamber with its rear wall inserted therein until it reaches the closed rear end of the vibrator assembly chamber. This positions the button switch flush against this rear wall and makes it actuatable from the outside of the air mattress merely by pusing against the button switch. Thus it is convenient to turn the vibrator motor on and off by merely actuating the button switch.

DESCRIPTION OF THE PREFERRED EMBODIMENT

Figure 1:
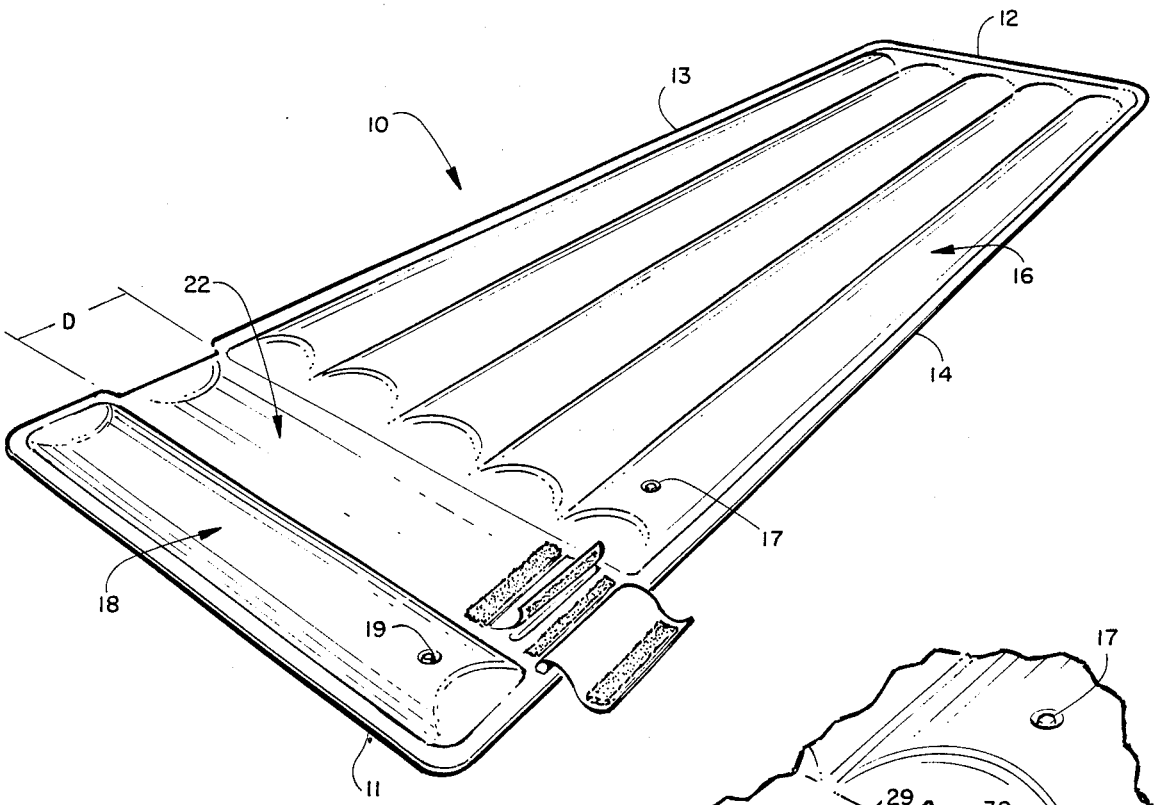
FIG. 1 is a perspective view of applicant's novel waterproof inflatable massage air mattress.
Figure 2:
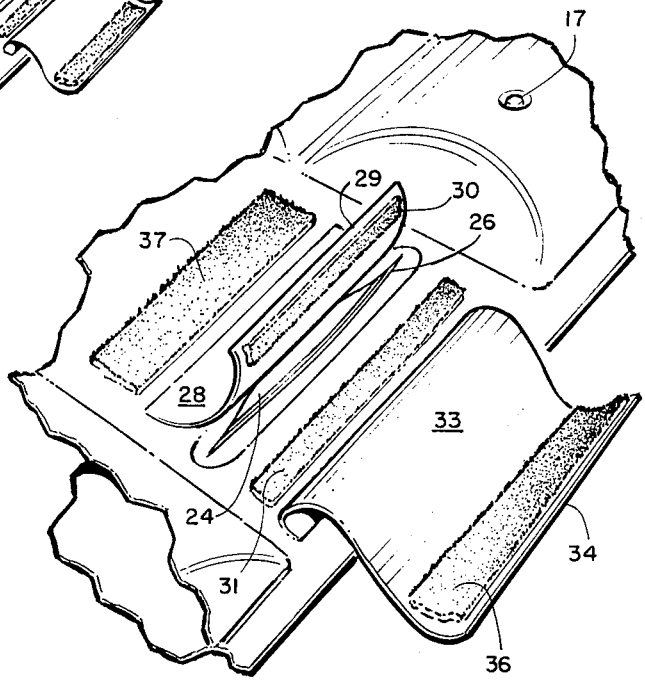
FIG. 2 is an enlarged partial perspective view illustrating the open end of the vibrator assembly chamber and its linear seal.
Figure 3:
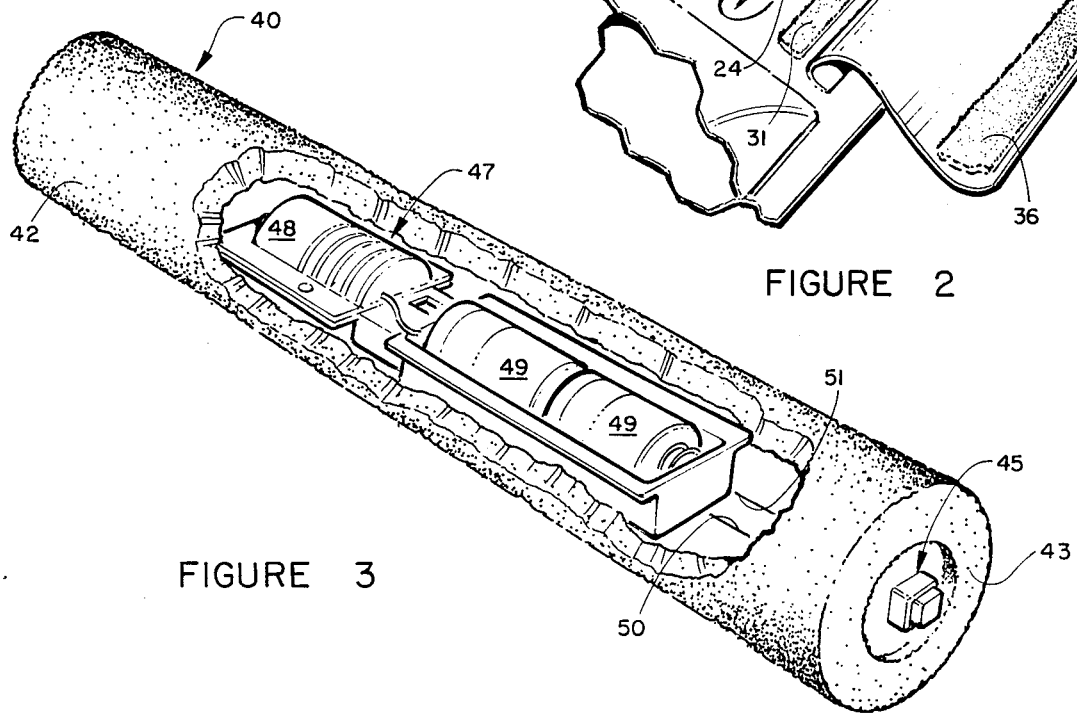
FIG. 3 is a perspective view of the vibrator assembly with portions broken away.

Applicant's novel waterproof inflatable air mattress will now be described by referring to FIGS. 1–3 of the drawing. The air mattress is generally designated numeral 10.

Air mattress 10 has a front end 11, a rear end 12, and laterally spaced side edges 13 and 14. Inflatable body cushion portion 16 has longitudinally extending air chambers. It has an inflation nozzle 17. Inflatable head cushion portion 18 extends transversely and it has an inflation nozzle 19.

Head cushion portion 18 is spaced a distance D from the front end of body cushion portion 16. This space accommodates vibrator cushion portion 22. Vibrator assembly chamber 24 is formed in vibrator cushion portion 22. Its rear end is closed and its front end has a water impermeable zipper or linear seal 26. A primary flap 28 has a front end 29 having a Velcro hook and loop type fastener strip attached thereto. When primary flap 28 is in its closed position its Velcro hook and loop type fastener strip 30 mates with Velcro hook and loop type fastener strip 31 to provide a protective wall over the linear seal 26. A secondary flap 33 has a front end 34. A Velcro hook and loop type fastener strip 36 is formed on its bottom surface and when it is in its closed position it mates with Velcro hook and loop type fastener strip 37.

Vibrator assembly 40 has a tubular foam core 42 having a front end wall closing its one end and a rear wall 43 closing its rear end. A button switch 45 is mounted in rear wall 43. A vibrator unit 47 is protectively mounted within the center of tubular foam core 42. Vibrator unit 47 has a vibrator motor 48, a plurality of D-cell batteries 49, and electrical wires 50 and 51 connect the motor, batteries, and switch in a conventional manner.

What is claimed is:

1. A waterproof inflatable massage air mattress comprising:

an elongated air mattress having a longitudinal axis, said air mattress having a top surface, a front end, a rear end and spaced lateral edges;

a transversely extending inflatable head cushion portion located adjacent the front end of said air mattress;

a longitudinally extending inflatable body cushion portion whose one end is located adjacent the rear end of said air mattress and whose other end is spaced a predetermined distance from said head cushion portion;

a vibrator assembly chamber formed in said air mattress intermediate said inflatable body cushion portion and said inflatable head cushion portion, said chamber having a closed rear end and a front end that is open and has means for opening and closing it that are water impermeable; and a vibrator assembly that may be inserted into or removed from said vibrator assembly chamber.

2. An air mattress as recited in claim 1 wherein said means for opening and closing the front end of said vibrator assembly chamber is a linear seal structure.

3. An air mattress as recited in claim 2 further comprising a primary flap that folds over said linear seal structure to provide a protective cover therefor, and a strip of Velcro hook and loop type fastener (strip fastening means) secures said primary flap in a closed position.

4. An air mattress as recited in claim 3 further comprising a secondary flap that folds over said primary flap to provide a protective cover therefor, and a strip of Velcro hook and loop type fastener (strip fastening means) secures said secondary flap in a closed position.

5. An air mattress as recited in claim 1 wherein said vibrator assembly comprises a tubular foam core closed at its rear end by a rear wall and closed at its front end by a front wall, and a vibrator unit is removably received within said tubular foam core.

6. An air mattress as recited in claim 5 wherein said vibrator unit comprises a vibrator motor and batteries that are mounted in a support housing and they are electrically connected to each other and also to a button switch that is mounted in said rear wall.

* * * * *